US011083234B2

(12) United States Patent
Hyslop

(10) Patent No.: US 11,083,234 B2
(45) Date of Patent: Aug. 10, 2021

(54) NEWBORN ANTI-SCRATCH AND CHEW MITT

(71) Applicant: Munch Baby Inc., Burlington (CA)

(72) Inventor: Melissa Hyslop, Burlington (CA)

(73) Assignee: Munch Baby Inc., Burlington (CA)

( * ) Notice: Subject to any disclaimer, the term of this patent is extended or adjusted under 35 U.S.C. 154(b) by 0 days.

(21) Appl. No.: 17/076,571

(22) Filed: Oct. 21, 2020

(65) Prior Publication Data

US 2021/0030088 A1 Feb. 4, 2021

Related U.S. Application Data

(60) Provisional application No. 62/923,884, filed on Oct. 21, 2019.

(51) Int. Cl.
*A41D 19/01* (2006.01)
*A61J 17/00* (2006.01)

(52) U.S. Cl.
CPC ..... *A41D 19/01* (2013.01); *A61J 17/10* (2020.05)

(58) Field of Classification Search
CPC . A61J 2017/008; A61J 17/02; A41D 19/0048; A41D 19/01
USPC ..... 2/158
See application file for complete search history.

(56) References Cited

U.S. PATENT DOCUMENTS 4,559,647 A * 12/1985 Smith ..... A41D 15/007 2/158
5,515,547 A * 5/1996 Middleton ..... A41D 19/00 2/158
5,774,894 A * 7/1998 Yates ..... A41D 19/0041 2/158
6,338,163 B1 * 1/2002 Markson ..... A41D 19/0017 2/161.6
7,117,541 B2 * 10/2006 Hozack ..... A41D 19/01594 2/161.5
D558,404 S * 12/2007 Van Trojen ..... D29/120.1
(Continued)

FOREIGN PATENT DOCUMENTS

CA 2559980 A1 * 9/2005 ..... A41D 19/01

OTHER PUBLICATIONS

Notification, International Search Report, and Written Opinion of the International Searching Authority in PCT application PCT/US2020/056689 dated Jan. 27, 2021, 14 pages.

*Primary Examiner* — Jillian K Pierorazio
(74) *Attorney, Agent, or Firm* — David A. Jones; Nadesan Beck P.C.

(57) ABSTRACT

The invention is directed to an anti-scratch and chew mitts that are designed to have a selectively exposed teething surface. The selectively exposed teething surface can have teething elements for an infant to chew while teething. The anti-scratch and chew mitt can have a reversible teething cap that can be reconfigured from a teething configuration to a protective configuration. The teething elements being exposed about an outer surface of the teething cap in the first teething configuration. The teething cap is reversible such that the teething cap can be folded inside-out and over itself in a second protective configuration. In the second protective configuration the first surface of the teething cap having the teething elements is inverted upon itself thereby containing the outer surface having the teething elements of the teething cap within an interior of the teething cap in the second configuration.

18 Claims, 10 Drawing Sheets

(56) References Cited

U.S. PATENT DOCUMENTS

D652,609 S * 1/2012 Walker ..... D2/621
8,832,864 B1 * 9/2014 Braden ..... A41D 13/1272 2/80
D783,265 S * 4/2017 Boudreau ..... D2/980
9,781,957 B2 * 10/2017 Mack ..... A41D 19/0017
D866,775 S * 11/2019 Peng ..... D24/195
D870,902 S * 12/2019 Peng ..... D24/195
D908,290 S * 1/2021 Kessler ..... D29/117.1
2005/0222621 A1 * 10/2005 Duwelius ..... A61J 17/02 606/235
2006/0004412 A1 * 1/2006 Gilbert, Jr. ..... A41D 19/01 606/234
2009/0143622 A1 6/2009 Perry
2009/0143822 A1 * 6/2009 Perry ..... A61J 17/10 606/235
2012/0042436 A1 * 2/2012 Jenkin ..... A41D 19/01 2/158
2014/0082825 A1 * 3/2014 Clark ..... A41D 19/01 2/158
2014/0207187 A1 * 7/2014 Kiraly ..... A61J 17/111 606/223
2014/0250565 A1 * 9/2014 Willows ..... A41D 19/0006 2/160
2014/0352030 A1 * 12/2014 Holland ..... A63D 5/10 2/160
2015/0209240 A1 * 7/2015 Steward ..... A61J 17/02 606/235
2015/0257466 A1 * 9/2015 Clayton ..... A41D 19/01 2/158
2016/0302498 A1 * 10/2016 Kreft ..... A41D 19/0017
2018/0014587 A1 * 1/2018 Enderlin ..... A41D 27/285
2018/0055741 A1 * 3/2018 Hyslop ..... A41D 19/01
2018/0220724 A1 * 8/2018 Bunn ..... A41D 13/1236
2018/0263858 A1 * 9/2018 Williams ..... A41F 1/06

* cited by examiner

NEWBORN ANTI-SCRATCH AND CHEW MITT

CROSS-REFERENCE TO RELATED APPLICATIONS

This application claims priority to and the benefit of U.S. Provisional Application No. 62/923,884, filed Oct. 21, 2019, titled NEWBORN ANTI-SCRATCH AND CHEW MITT, the contents of which are incorporated herein by reference in their entireties and for all purposes.

BACKGROUND OF THE INVENTION

At an early age, infants begin to experience teething when their first set of teeth begin to break through their gums. Generally teething starts at an age of 6 to 8 months, but can begin as early as 3 months. Teething pain often begins 3 to 5 days before the tooth emerges from the gums, and typically involves soreness and swelling of the gums. Because teething can be quite painful, most teething infants naturally put things in their mouth to chew on in an attempt to relieve pressure on the gums and soothe the pain of teething. Infants additionally have a sucking reflex which is commonly soothed using a pacifier or other toy that can be put in the mouth.

Teething is the process by which an infant's first teeth (the deciduous teeth, often called "baby teeth" or "milk teeth") sequentially appear by emerging through the gums, typically arriving in pairs. The mandibular central incisors are the first primary teeth to erupt, usually between 6 and 10 months of age. It can take several years for all 20 teeth to complete the tooth eruption.

A variety of devices and products have been used to provide aid for an infant while teething. Common teething devices include teething rings, pacifiers, soothers, tags on toys, rattles, and other hard, semi-hard, or malleable devices. These teething devices and produce often have edges, protrusions, and other teething features that provide teething elements for the infant while teething.

However, many of these teething devices can also lead to scratching, poking or inadvertent uncomfortable contact with the infant. As such, there is a need to provide a selectively protective teething device that provides a selectable or reconfigurable teething and protective surface for the infant.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

The invention disclosed herein is directed to anti-scratch and chew mitts that are designed to have a selectively exposed teething surface. The selectively exposed teething surface can have teething elements for an infant to chew while teething. The anti-scratch and chew mitt can have a reversible teething cap that can be reconfigured from a teething configuration to a protective configuration. The teething elements being exposed about an outer surface of the teething cap in the first teething configuration. The teething cap is reversible such that the teething cap can be folded inside-out and over itself in a second protective configuration. In the second protective configuration the first surface of the teething cap having the teething elements is inverted upon itself thereby containing the outer surface having the teething elements of the teething cap within an interior of the teething cap in the second configuration.

According to the teachings disclosed herein a newborn anti-scratch and chew mitt is designed to have a selectively exposed teething surface. The selectively exposed teething surface can have teething elements for an infant to chew while teething. The newborn anti-scratch and chew mitt can have a reversible teething cap that can be reconfigured from a teething configuration, to a protective configuration. In the teething configuration, a chewable silicone surface with teething protrusions is provided. In the protective configuration a soft textile cloth material covering is provided to prevent or reduce the likelihood of the infant scratching themselves whether by a teething protrusion or by their own fingers or fingernails.

The newborn anti-scratch and chew mitt can include a glove portion including an inner glove body and a flap made of fabric and open at a bottom end to receive an infant's hand up to the wrist. The newborn anti-scratch and chew mitt can further include a teething surface, which can be in the form of a cap extending over a portion of the glove portion in the first teething configuration, the glove portion extending within an interior volume of the teething cap when in the first configuration and is concealed from the top of the glove portion to the bottom edge of the teething cap by the teething cap when in the first teething configuration.

The teething cap has teething elements disposed on a first surface of the teething cap. The teething elements can be exposed about an outer surface of the teething cap in the first teething configuration, for example. The teething cap is reversible such that the teething cap can be folded inside-out and over itself in a second protective configuration. In the second protective configuration the first surface of the teething cap having the teething elements is inverted upon itself thereby containing the outer surface having the teething elements of the teething cap within an interior of the teething cap in the second configuration.

The glove portion can include a protective surface, such as a flap. The flap can be contained within the teething cap in the first teething configuration, and the flap can be exposed as an exterior protective surface of the newborn anti-scratch and chew mitt in the second protective configuration. The protective flap can be in the form of a fabric flap or fabric extension and can be connected to the glove portion at a perimeter of the glove. Thus, the fabric flap can form an interior surface of the newborn anti-scratch and chew mitt in the first teething configuration. And, the fabric flap forms an exterior surface of the newborn anti-scratch and chew mitt in the second protective configuration.

The glove portion can be made from fabric and open at a bottom end to receive the infant's hand up to the wrist. The teething surface of the teething cap can include the teething elements extending therefrom. The teething elements can include protuberances, molded shapes, and indentations, for example. The teething surface being invertible so as to contain the teething elements within an outer surface of the newborn anti-scratch and chew mitt. Thus, the teething cap can have the teething surface disposed on a first surface of the teething cap and an interior of the teething cap is connected to the protective flap of fabric.

The position of the teething portion relative to the protective portion can be referred to as extending adjacent to the glove portion in a second configuration or the teething portion can be referred to as covering the glove portion in the first configuration. For example, in the first configuration the cap having the teething protrusions can cover the end of the glove and in the second configuration the cap is folded in-side-out and extends adjacent to the glove portion.

A method of manufacture of the anti-scratch chew mitt can include connecting, such as sewing, a peripheral edge of the cap to a middle of a side of the glove. The method of manufacture of the anti-scratch and chew mitt can further include connecting, such as sewing a peripheral edge of the cap to an end of a section of textile. The cap of the anti-scratch chew mitt can also comprise two portions sewn together to create an annular seam. The annual seam can extend along vertically along the sides of the teething cap and provide a connection point for both the glove and the fabric protection flap. The method of manufacture of the anti-scratch chew mitt can further include sewing two portions of the cap to the sides of the glove, as well as sewing the portions of the cap together.

A first half of the teething cap can be sewn to the glove around a periphery thereof as well as along a bottom edge thereof. A second half of the teething cap can be sewn to the glove around a periphery thereof but not along a bottom edge of the second half of the teething cap. Rather, a bottom edge of the second half of the teething cap can be sewn to the flap or periphery of the protective pocket of material.

Additional features, uses, manufacturing methods, and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION

Figure 1:
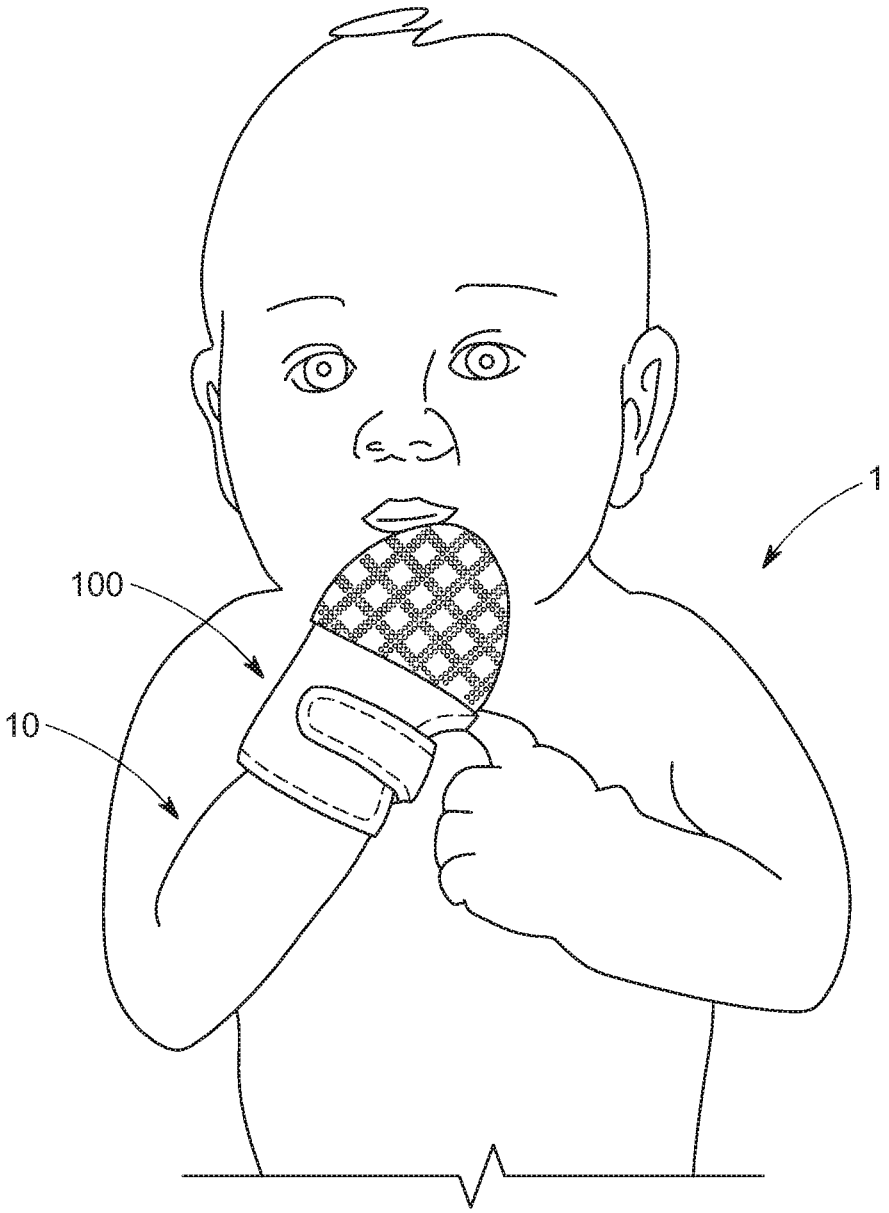
FIG. 1 illustrates a teething infant chewing on the newborn anti-scratch and chew mitt.

Embodiments of the invention relate to newborn anti-scratch and chew mitts including a reversible teething cover for newborn sized infants to protect them from scratching themselves yet allowing the mitt to be reconfigured to expose a teething surface for the teething infant to chew. In a protective configuration a soft cloth surface is provided. The soft cloth surface covers the infants hands and prevents the infant from scratching itself by either teething protrusions and their own fingers, hands, and fingernails.

The newborn anti-scratch and chew mitt can include a teething cap that has a first surface that has teething elements disposed thereon. In a first teething configuration the teething cap has the first surface exposed; and in a second protective configuration the teething cap is manually reversed in-side-out to expose a protective surface. When the teething cap is reversed in-side-out to expose the second protective surface the teething elements are no longer exposed and the infant is prevented from scratching himself or herself on the teething elements or from inadvertently poking or scratching themselves with their fingers.

The newborn anti-scratch and chew mitt can include a glove portion. The glove portion can include a top and a bottom. The top can be enclosed and the bottom can include an opening for receiving the infant's hand and wrist. The glove portion can include a slit for expanding the opening so as to place the glove portion of the mitt over the infant's hand and wrist. The glove portion can include a baby-safe VELCRO hook and loop secured strap for securing the newborn anti-scratch and chew mitt to the wrist of the infant.

The glove portion can include a flap or exterior pocket. The flap can be connected to the glove portion and can be connected to an edge of the teething cap such that when the teething cap is reversed by folding the teething cap in-side-out, the flap extends over an exposed second surface of the teething cap so as to further protect the infant from the teething cap. Further, when the teething cap is reversed by folding the teething cap in-side-out the teething elements are no longer exposed. Rather, when in the reversed position, the teething elements are disposed within an interior of the teething cap.

Thus, the teething cap and mitt can be described as having at least two positions or configurations. The first teething configuration is when the teething cap is disposed over the top of the glove portion. In the first teething configuration the teething elements are exposed on the outer first surface of the teething cap. In the first position, the infant is able to chew on the teething elements of the teething cap to help relieve some of the discomfort previously discussed and associated with teething.

When the teething cap and mitt is reversed into a second protective configuration the second surface of the teething cap is disposed on the outside of the teething cap and the first surface and teething elements of the teething cap are contained inside an interior of the teething cap. That is, when the teething cap is reversed by manually folding the teething cap in-side-out, and rotating the teething cap about the glove portion, the inner second surface becomes an outer surface or the teething cap and the previously inner surface of the teething cap becomes an outer surface of the teething cap in the second protective configuration.

As previously mentioned, the glove portion can include a flap and the flap can be connected to the glove portion at one end and connected an edge of the teething cap at an opposing end of the flap. The edge of the teething cap on an opposing side of the flap can be connected to the glove portion and act as a rotational pivot around which the teething cap rotates when reversed into the second position. When in the second configuration, the teething cap can be disposed adjacent to the glove portion and the flap of the glove portion can overlay the top end of the glove portion. When in the second position, the top of the teething cap can be directed toward the bottom of the glove portion. The silicone teething cap portion can be made of a flexible resilient polymer material such as 100% food grade silicone. The glove portion can be made from a textile such as cotton, a cotton blend, or other soft textile material.

Figure 2:
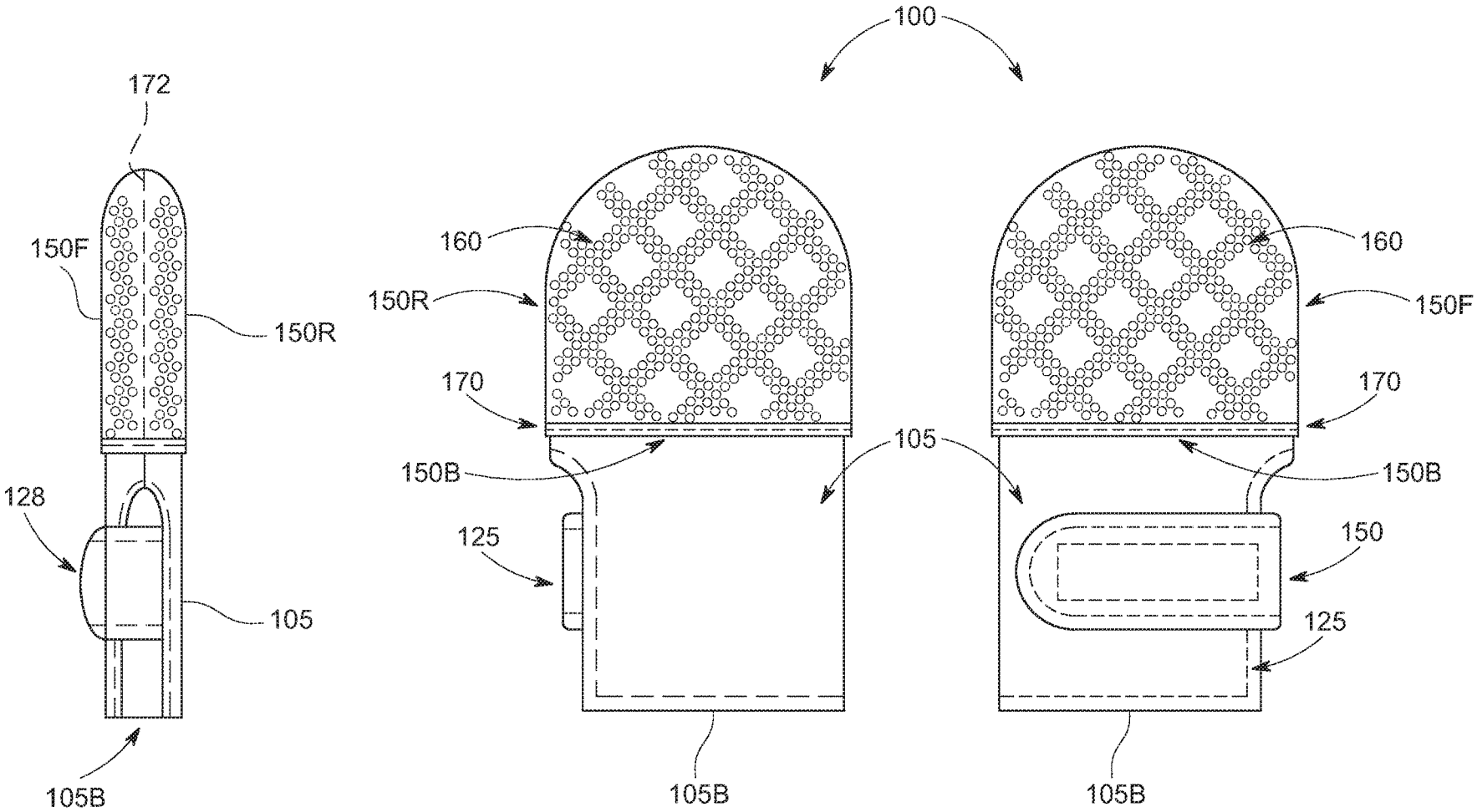
FIG. 2 illustrates a front view of the anti-scratch chew mitt in a teething configuration.

FIG. 1 illustrates a newborn anti-scratch and chew mitt 100 being chewed on by an infant 1. The newborn anti-scratch and chew mitt 100 covers the hand and wrist of the infant's arm 10 and is affixed thereto so as to allow the infant to chew on the newborn anti-scratch and chew mitt 100 without the newborn anti-scratch and chew mitt 100 falling off the hand and wrist of the infant's 1 arm 10. The hand and wrist of the infant 1 is inserted fully into the newborn anti-scratch and chew mitt 100. As illustrated, the infant 1 has placed the newborn anti-scratch and chew mitt 100 in his mouth and is chewing thereupon to ease the discomfort associated with teething. FIG. 2 shows the anti-scratch and chew mitt 100 from a front perspective on the left and from a rear perspective on the right.

Figure 3:
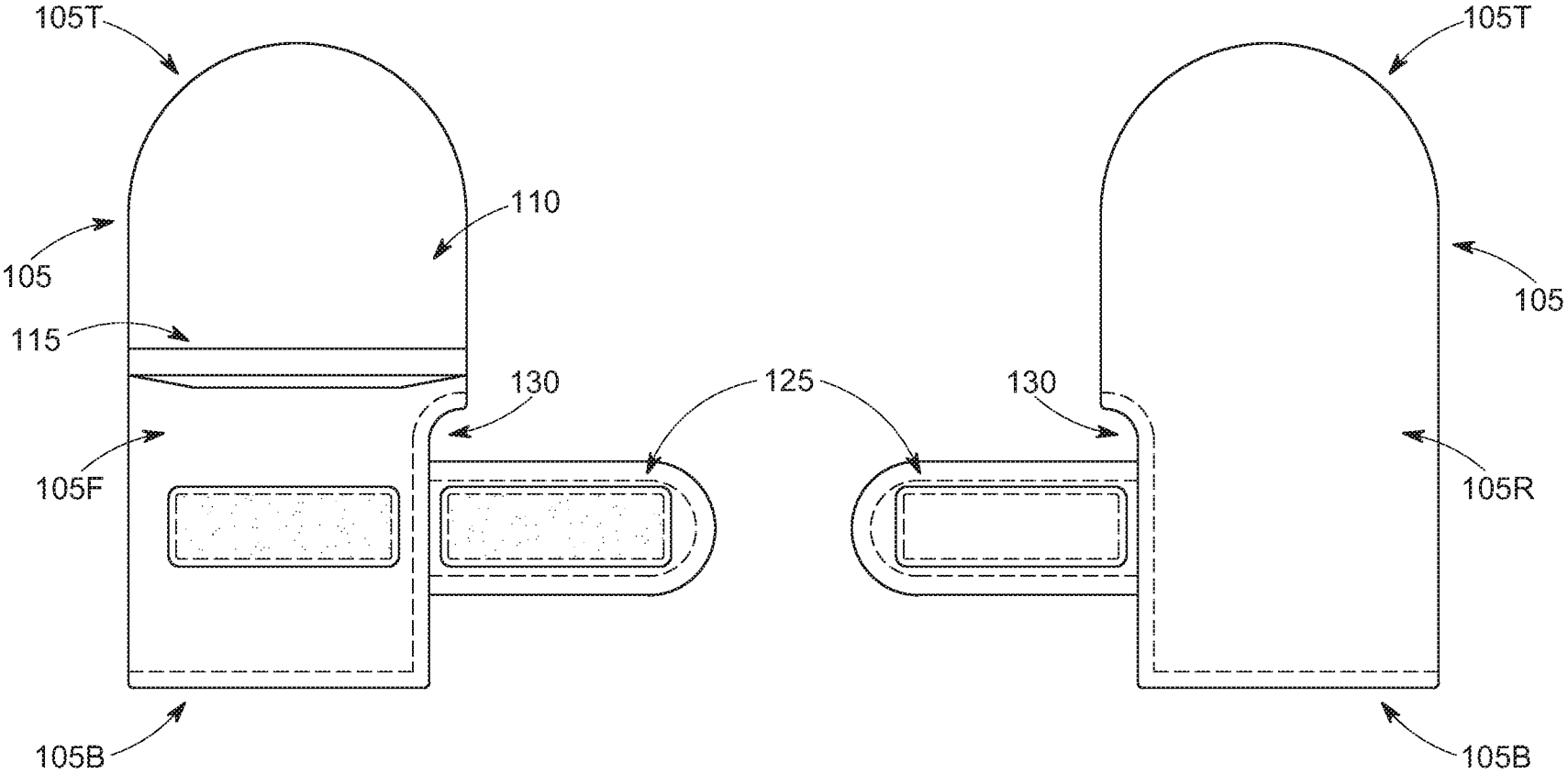
FIG. 3 illustrates front and rear views of the newborn anti-scratch and chew mitt in a protective configuration.

FIGS. 2 and 3 illustrate an example of an anti-scratch and chew mitt 100 including a glove portion 105 made of fabric and open at a bottom end 105B to receive an infant's hand up to the wrist as shown in FIG. 1. Referring still to FIGS. 2 and 3, the anti-scratch and chew mitt 100 further includes a teething cap 150 extending over a portion of the glove portion 105 in a first teething position shown in FIG. 2. The glove portion 105 extends within an interior volume of the teething cap 150 when in the first teething position and is concealed from the top of the glove portion 105 to a bottom edge of the teething cap 150 by the teething cap 150 when in the first teething position. The teething cap 150 has teething elements 160 disposed on a first surface of the teething cap 150. The teething elements 160 are exposed about an outer surface of the teething cap 150 in the first teething position shown in FIG. 2.

The teething cap 150 is reversible such that the teething cap 150 is folded inside out and over the top of the glove portion 105 and adjacent to the glove portion 105 in a second protective position shown in FIG. 3. The first surface of the teething cap 150 having the teething elements 160 is disposed within an interior of the teething cap 150 in the second protective position Shown in FIG. 3

The glove portion 105 includes, or is coupled to, a protective surface 110, the protective surface 110 being contained within the teething cap 150 in the first teething position as shown in FIG. 2. The protective surface layer, or flap, 110 being exposed as an exterior protective surface layer 110 over the teething cap 150 and top portion 105T of the glove portion 105 in the second protective position shown in FIG. 3.

The anti-scratch and chew mitt 100 including the protective surface layer 110 can be in the form of a fabric flap and connected to the glove portion 105 at an upper and side perimeter of the glove portion 105 and contained within the teething cap 150 in the first position shown in FIG. 2. The fabric flap 110 is folded over the second surface of the teething cap in the second position. Thus, the fabric flap 110 can form an interior surface of the anti-scratch and chew mitt 100 in the first teething position shown in FIG. 2. And, the fabric flap 110 can form an exterior surface of the anti-scratch and chew mitt 100 in the second protective position shown in FIG. 3.

The glove portion 150 can be made of fabric or other material and is open at the bottom end 150B to receive the infant's hand up to the wrist as shown in FIG. 1, for example. The teething surface of the teething cap 150 including the teething elements 160 extending therefrom. The teething surface of the teething cap 150 being invertible so as to contain the teething elements 160 within an outer surface of the anti-scratch and chew mitt 100 formed by a rear side 105R of the glove portion 105 and the fabric flap 110 disposed over the inverted cap portion 150 disposed adjacent to the front side 105F of the glove portion 105.

An interior of the teething cap can also be connected to the protective fabric flap 110 according to some embodiments. For example, the teething cap 150 can have two portions connected, for example, sewn together, along a side and a top periphery of the two teething cap portions.

The front side 105F of the glove portion 105 can be coupled to a lower bottom periphery 150B or a lower portion of the teething cap 150. As shown in FIG. 2, side 150F of the glove portion 150 can be connected, such as including stitching 170 disposed in a lower stitching channel, coupling approximately half of the lower periphery 150B of the teething cap 150 to the front side 105F of the glove portion and the other half of the lower periphery 150B of the teething cap being coupled to, such as by stitching 170 disposed within a stitching channel 170 as illustrated in FIG. 2. The protective fabric layer 110 can be connected, such as by stitching 170 disposed in a stitching channel as shown in FIG. 2, to approximately half of the lower periphery 150B of the teething cap.

The anti-scratch and teething mitt 100 can be configured to prevent the infant, baby or child from scratching their self as shown in FIG. 1. The teething cap 150 can have the one or more teething elements 160 disposed within an interior of the teething cap 100 in the second anti-scratch configuration shown in FIG. 3.

The anti-scratch and teething mitt 100 is also configured to protect the infant, baby or child from scratching their self according to the second configuration shown in FIG. 3. The teething cap 150 has the teething elements 160 disposed within the interior of the teething cap 150 in the second anti-scratch configuration illustrated in FIG. 3.

The anti-scratch and teething mitt 150 is configured to allow the baby, child or infant to chew on the teething elements 160 in the first teething configuration where the teething elements 160 of the cap 150 are exposed on the exterior of the teething cap 150 in the first teething configuration.

The side of the glove portion 105F can be sewn to the lower peripheral edge 150B of the cap portion 150. The cap 150 can comprise the two portions 150F and 150R sewn together along the top and side peripheral edges of the two portions 150F and 150R of the cap 150. The glove 105 and flap 110 can be sewn to the side and top peripheral edges of the two portions 150F and 150R of the cap 150.

The top of the front portion 105F of the glove portion 105 is concealed by the flap 110 down to the bottom lip 115 of the flap 110 in the second teething configuration. However, as discussed herein the portion of the front 105F of the glove portion 105 is exposed in the second protective configuration. In the second protective configuration, the flap 110 is reversed and folded inside-out such that the flap 110 and teething cap 150 are folded up, over and adjacent to the rear side 105R of the glove 105 as shown in FIG. 3.

The glove portion 105 has the rear side 105R that extends between the top 105T and bottom 105B of the glove portion 105 and generally defines a closed form sized and configured for fitting the hand of a young infant, baby or child therein. The glove portion 105 has the front side 105F shown below the flap 110 and opposite to the rear side 105R of the glove portion that can be substantially similar or the same in size and shape to the front side 105F of the glove portion according to the embodiment illustrated in FIGS. 2 and 3.

The flap 110 of the glove portion 105 extends from the lip 115 disposed about half of the length of the glove portion 105 from the top 105T of the glove portion 105. The flap 110 is connected, such as sewn or made integral, with the outer periphery of the glove portion 105 along the sides and top of the flap 115 to the top 105T of the glove portion 105.

A securing strap 125 can be attached to the glove portion 105 and can extend substantially parallel to the bottom 105B of the glove portion 105. The securing strap 125 can have fastener material such as VELCRO, buttons, or the like as does the front portion 105B of the glove portion 105 near the bottom 105B and below the lip 115 of the flap 110 in the second protective configuration, to allow the strap 125 to be pulled tight, and then suitably positioned and fastened using the fastener. A slit 130 is preferably provided along a side of the glove portion 105 to provide breathability and ensure comfort to the infant when the newborn anti-scratch and chew mitt 100 is worn for extended periods (see FIG. 1).

Figure 4A:
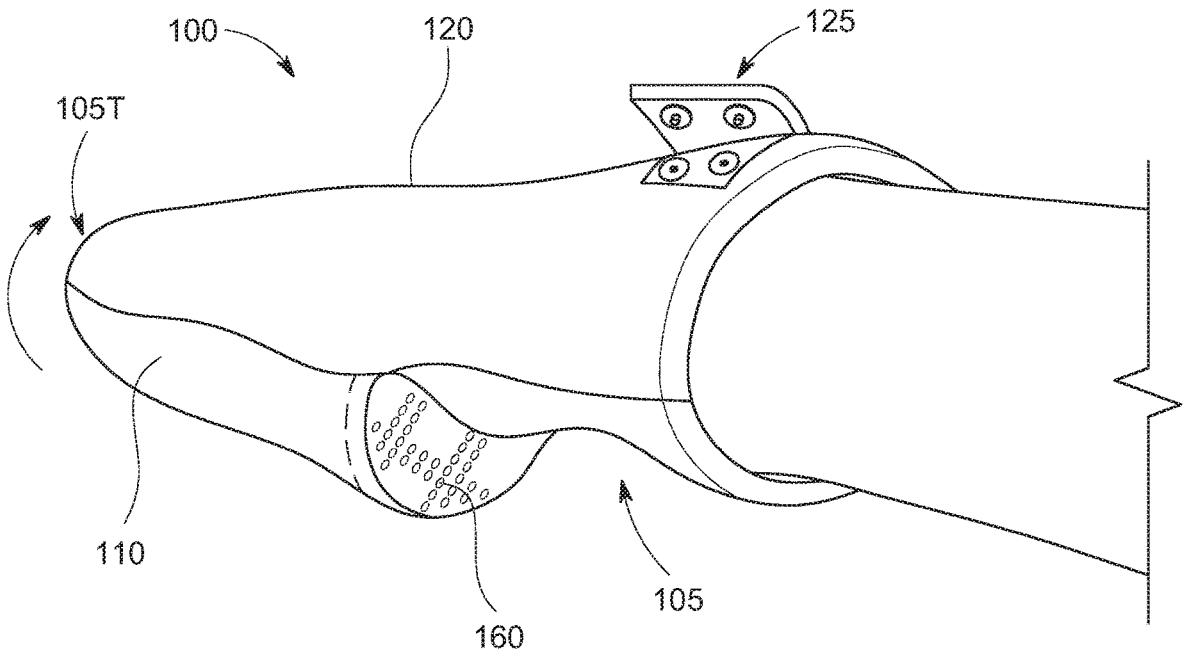
FIG. 4A illustrates a first teething configuration of the anti-scratch chew mitt in a protective configuration.
Figure 4B:
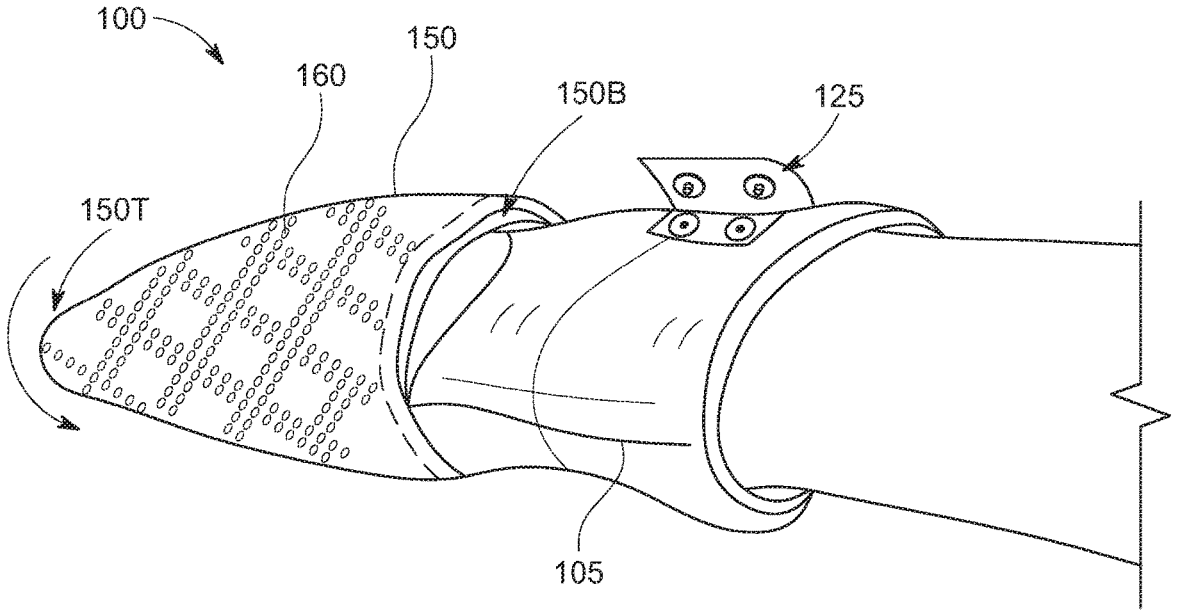
FIG. 4B illustrates a view of the newborn anti-scratch and chew mitt in a teething configuration.

Methods of using the anti-scratch and teething mitt 100 are illustrated in FIGS. 4A and 4B with the infant's hand in the anti-scratch and chew mitt. Further methods of using the anti-scratch and teething mitt are illustrated in FIGS. 5A, 5B, and 5C without the infant's hand in the anti-scratch and chew mitt 100.

Referring to FIGS. 4A and 4B, the infant's hand is placed within the glove portion 105. The fabric layer 110 extending over a first surface of the teething cap 150 to protect the infant from scratching their self as shown in FIG. 4A according to the second protective configuration. The cap 150 is folded in-side out and over an upper end of the glove portion 105 to expose the teething elements 160 thereby allowing the infant to chew on the teething elements 160 in the first teething configuration shown in FIG. 4B.

Figure 5A:
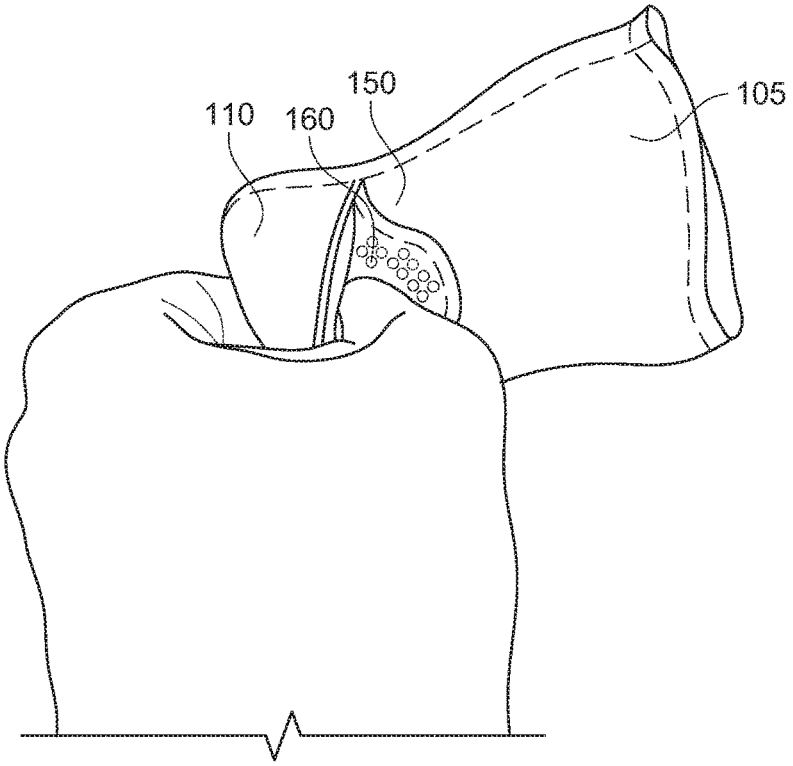
FIGS. 5A, 5B and 5C illustrate a method of use of the anti-scratch chew mitt or method of reconfiguration of the anti-scratch chew mitt.
Figure 5B:
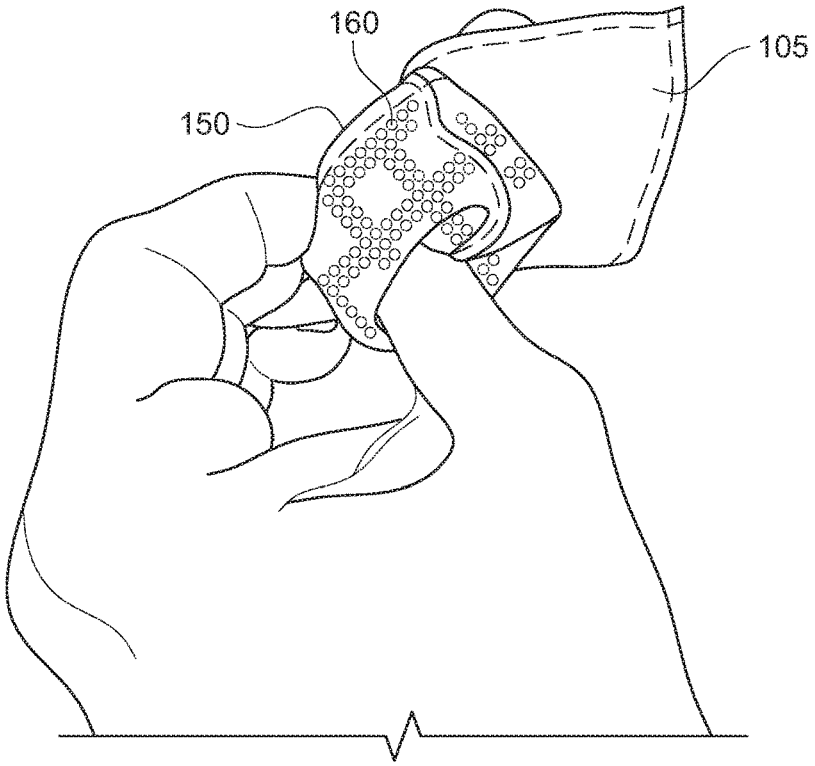
Figure 5C:
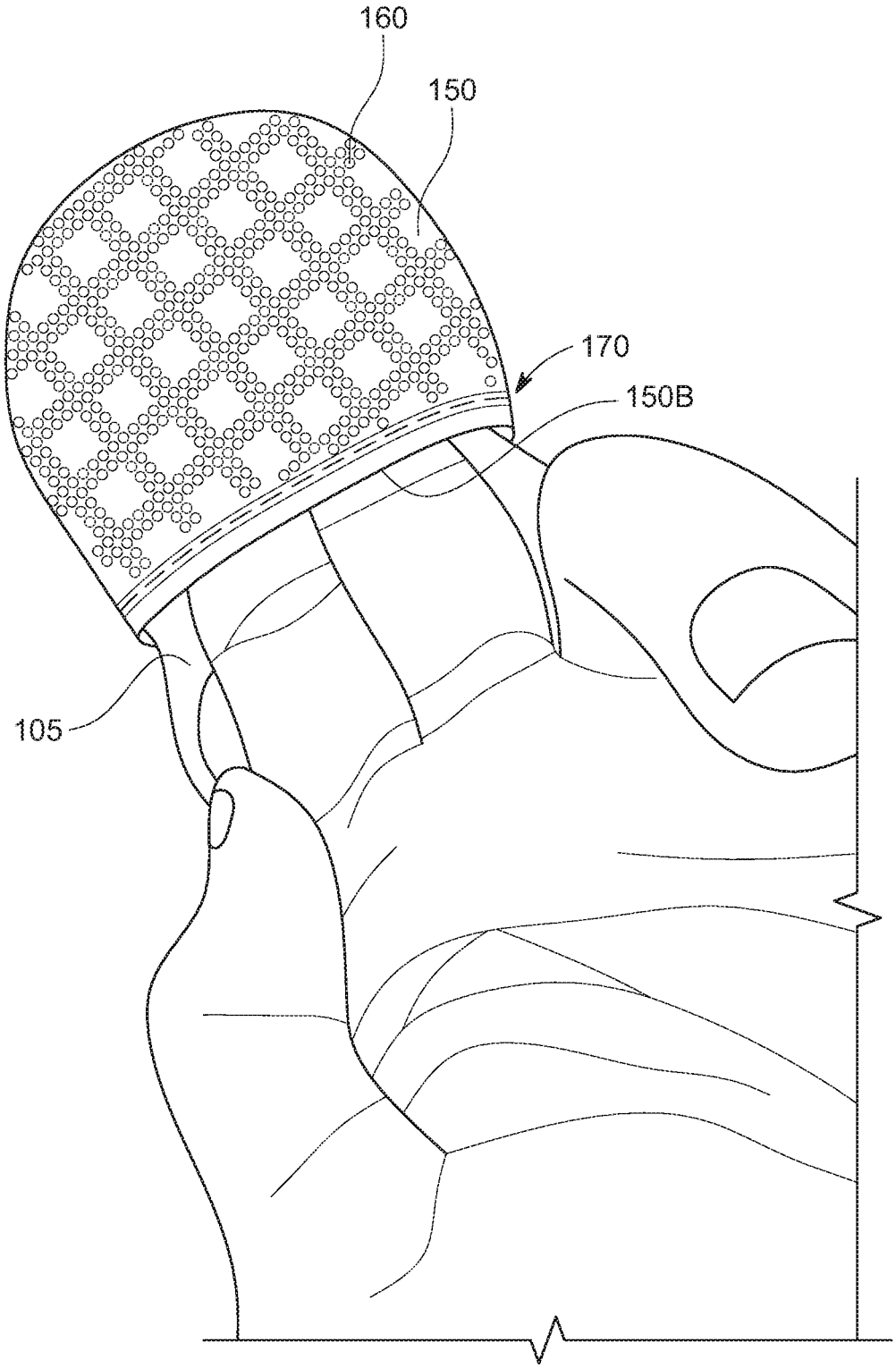
Figure 6:
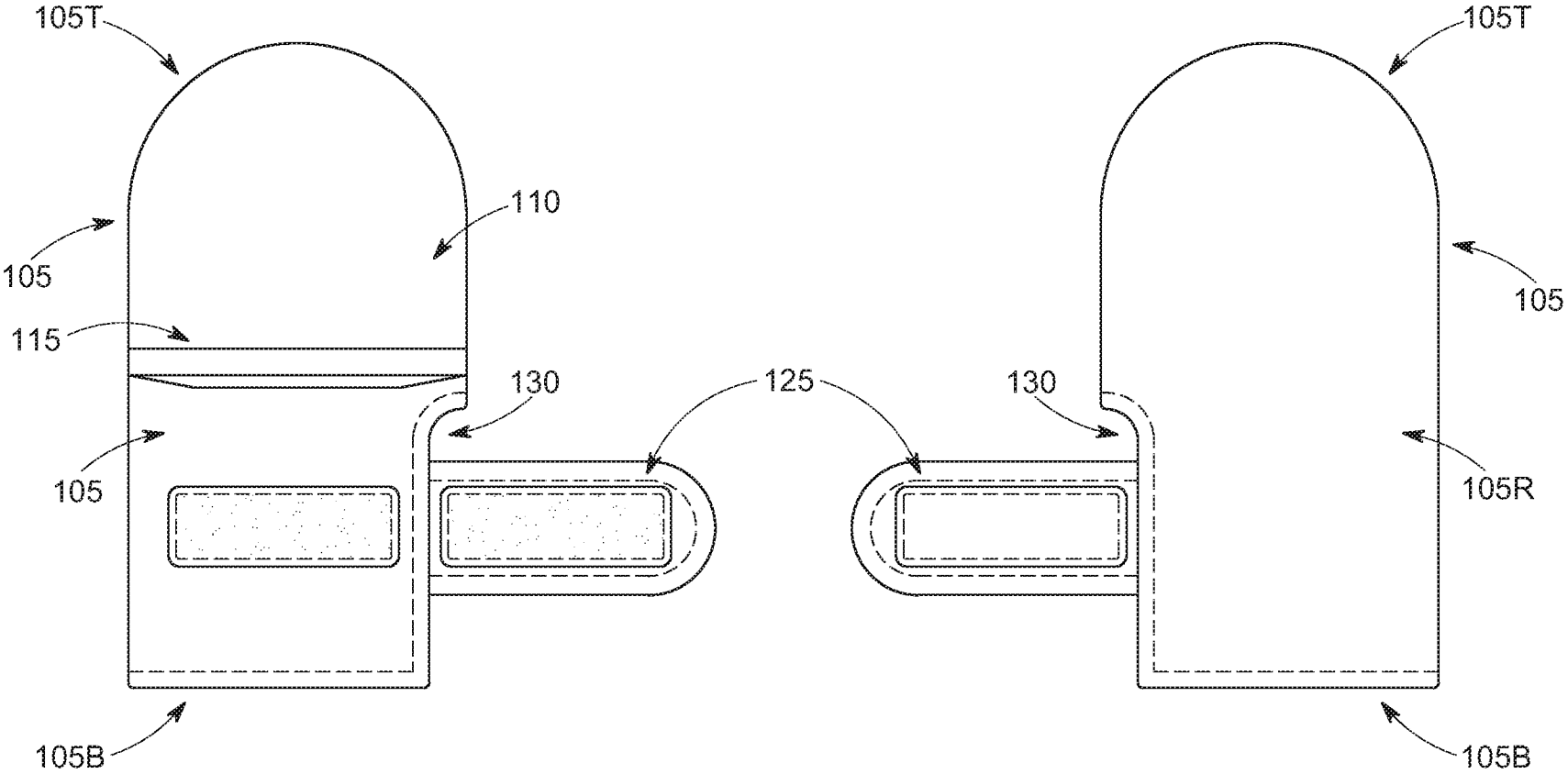
FIG. 6 illustrates a front view and a rear view of a fabric glove portion of the newborn anti-scratch and chew mitt and identifying portions thereof as a mid-manufacture portion of the newborn anti-scratch and chew mitt.

Referring to FIGS. 5A, 5B and 5C, The fabric layer 110 extends over the surface of the teething cap 150 in FIG. 5A to protect the infant from scratching their self according to the second protective configuration. The cap 150 is folded in-side out as shown in FIG. 5B and over an upper end of the glove portion 105 to expose the teething elements 160 thereby allowing the glove to be placed on the arm of an infant to chew on the teething elements 160 in the first teething configuration shown in FIG. 5C.

The method of reconfiguring a previously disclosed and described anti-scratch and chew mitt 100 from the teething configuration shown in FIGS. 4B and 5C to a protective configuration in FIGS. 4A and 5A is illustrated. The anti-scratch and chew mitt 100 includes the glove portion 105 and the flap 110 made of fabric and open at a bottom end to receive an infant's hand up to the wrist. The anti-scratch and chew mitt 100 further includes the teething cap 150 extending over a portion of the glove portion 105 in the first teething position shown in FIGS. 4B and 5C, the glove portion 105 extending within an interior volume of the teething cap 150 when in the first teething position and is concealed from the top 105T of the glove portion 105 to the bottom edge 150B of the teething cap 150 by the teething cap 150 when in the first position teething position.

The teething cap 150 has the teething elements 160 disposed on the first surface of the teething cap 150. The teething elements 160 being exposed about an outer surface of the teething cap 150 in the first teething position shown in FIGS. 4B and 5C. The teething cap 150 is reversible such that the teething cap 150 is folded inside-out and over itself in a second protective position shown in FIGS. 4A and 5A. The first surface of the teething cap 150 having the teething elements 160 is inverted upon itself in the second protective position shown in FIGS. 4 and 5A thereby containing the outer surface having the teething elements 160 of the teething cap 150 within an interior of the teething cap 150.

Figure 7:
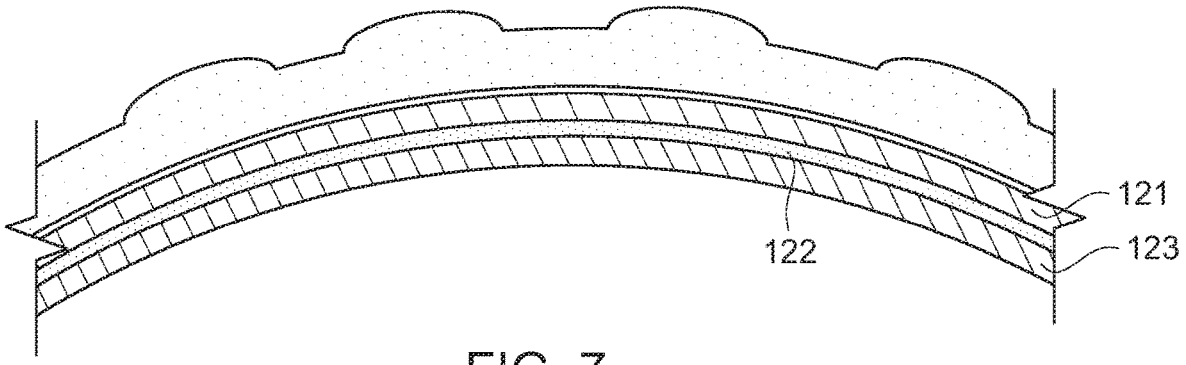
FIG. 7 illustrates a cross-sectional view of certain layers of the newborn anti-scratch and chew mitt that can be included.
Figure 8:
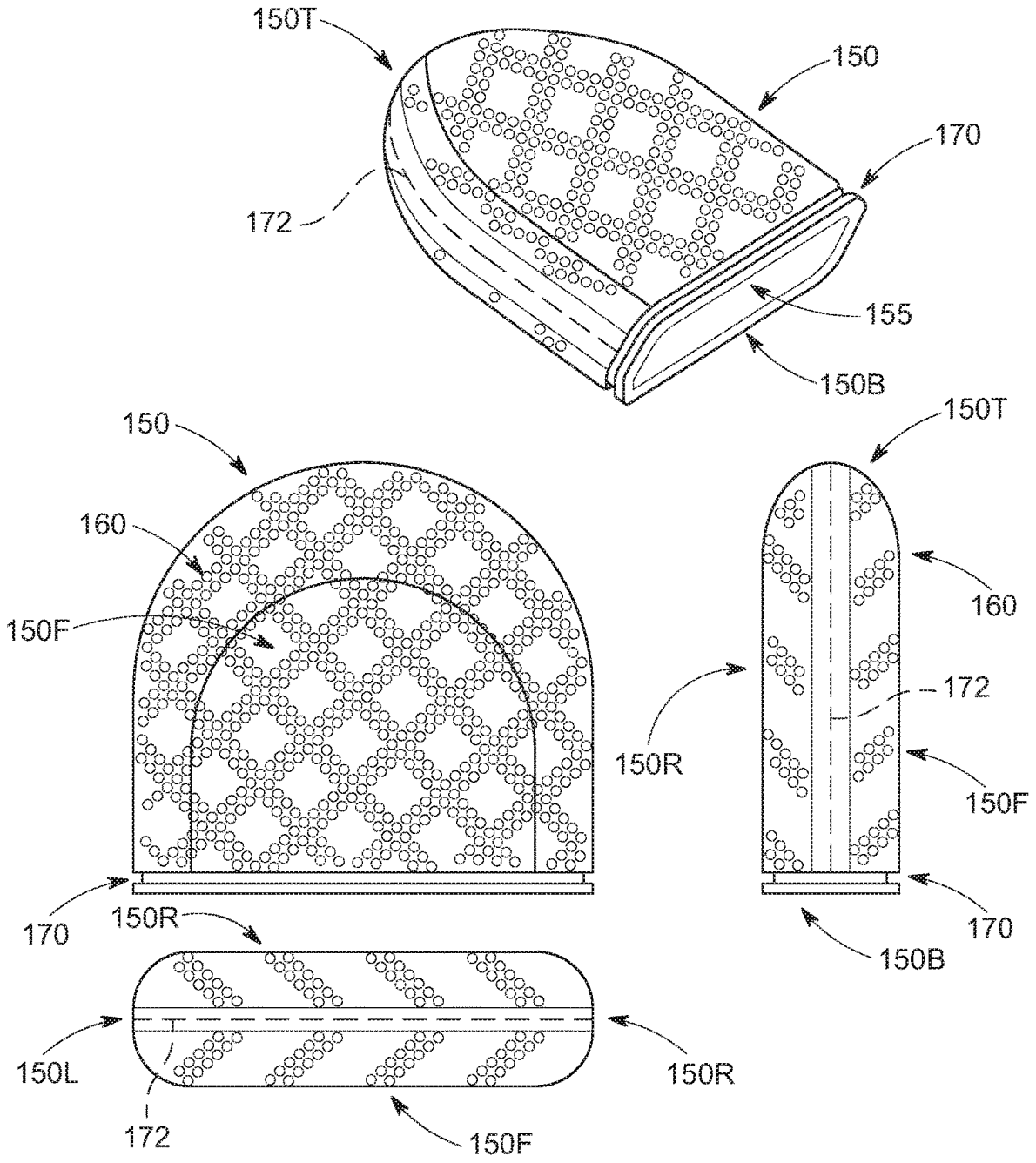
FIG. 8 illustrates a teething cap portion of the newborn anti-scratch and chew mitt.
Figure 9:
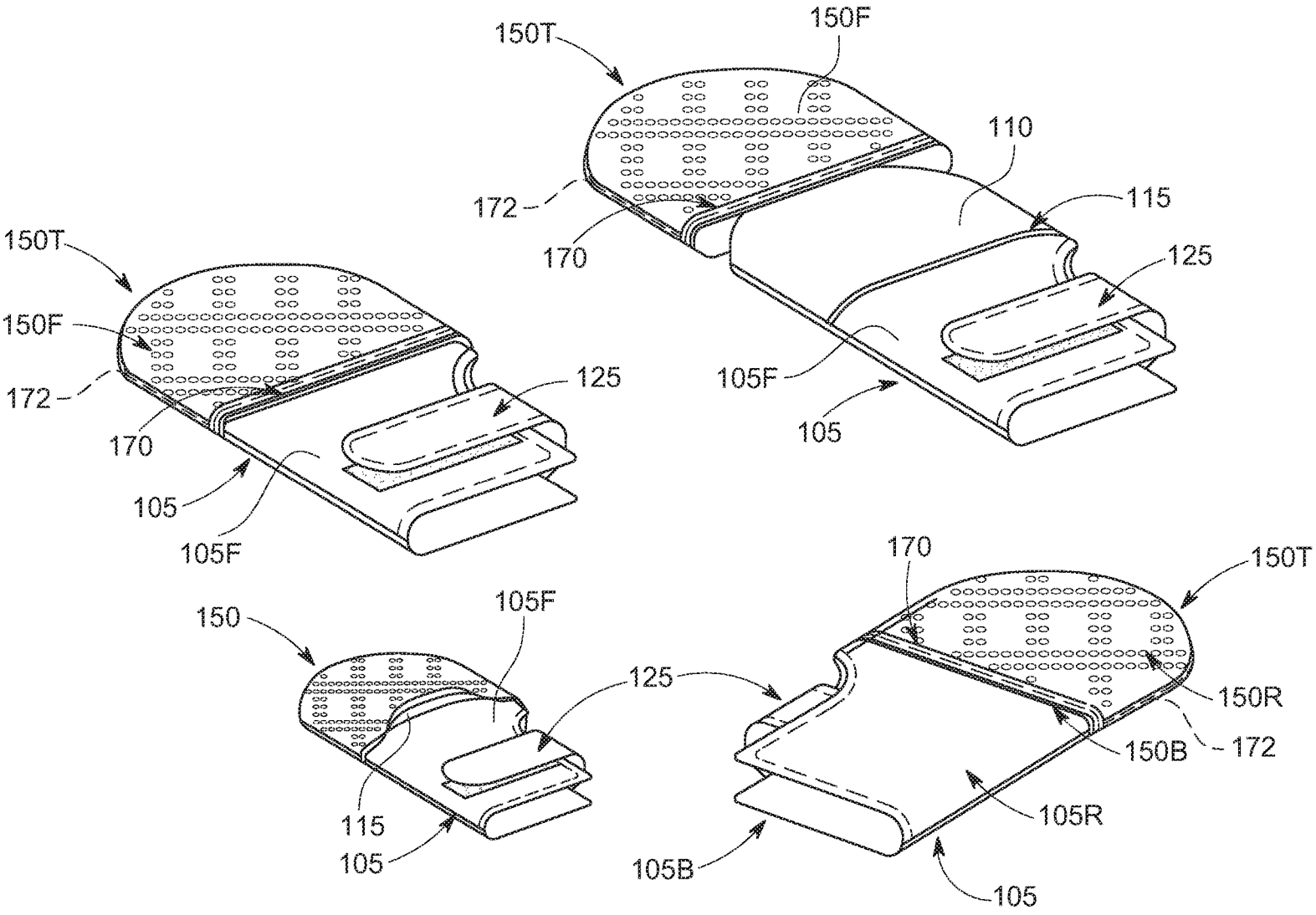
FIG. 9 illustrates the assembly and manufacture of the newborn anti-scratch and chew mitt including glove portion and the teething cap portion.

Referring to FIG. 6-9, components, assembly and manufacturing steps of the newborn anti-scratch and chew mitt 100 are illustrated. As shown in FIG. 9, the teething cap 150 is assembled over the end of the glove portion 105 to the end of the flap 115. The teething cap 150 is connected, in this instance sewn by stitching 170 disposed within a stitching channel to the glove portion 105 and flap 115. The front side portion 150F of the teething cap 150 is stitched at a bottom periphery to the flap 115 of the glove portion 105 and the rear portion 150R of the teething cap 150 is sewn to a rear side 105R of the glove portion 105.

The rear portion 150R of the teething cap 150 is preferably sewn to the glove portion 105 near the bottom edge 150B of the teething cap with stitches extending within a stitching channel 170. This manner of connection provides a secure connection between the teething cap 150 and glove portion 105 (e.g. see FIG. 9). According to other embodiments, the love portion 105 is not, or only partially, sewn within the cap portion 150, which may allow independent movement and freedom of the hand within the mitt 100. The protuberances 160 are provided at the area near the top 150T of the teething cap 150 where the infant chews on the exterior surface thereof. In some embodiments, the glove 105 remains independent of the teething cap 150 in this region, as the cap 150 is not attached to the outer layer of the glove 105, such that the infant can manipulate the 105 within the cap 150 as the infant teethes upon the cap 150.

However, as shown in FIGS. 8 and 9, the teething cap 150 can have a front portion 150F sewn 172 or otherwise connected to a rear portion 150R. The stitching 172 can connect the front portion 150F of the teething cap 150 to the rear portion 150R of the teething cap 150. The stitching 172 can also connect the top and side periphery of the teething cap 150 to the top and side periphery of the glove portion 105 and flap 110. Thus, during manufacture, a stitching step of connection between the front portion 150F and rear portion 150R of the teething cap 150 can also connect the top and side periphery of the teething cap 150 to the side and periphery of the glove portion 105 and flap 110.

An upper portion of the glove portion 105 extends within the teething cap 150 and may generally closely follow the contours thereof and optionally be sewn thereto. But since the glove portion 105 is only partially secured near the bottom edge 150B of the cap 150, portions of the glove portion 105 on one side 105R and the flap 110, which can be part of, separable or connected to, the glove portion 105. In addition, portions of the glove portion 105 that are below the bottom edge 150B of the teething cap 150 may move as freely as the glove portion's cloth construction permits.

As shown in FIGS. 6-9, a method of manufacturing, assembling, and/or constructing an anti-scratch and chew mitt can include manufacturing the fabric glove portion 105 of the anti-scratch and chew mitt 100. The fabric glove portion 105 being open at a bottom end 105B thereof to receive a hand and wrist of a baby therein as shown in FIG. 1. The fabric glove portion 105 includes a flap 110 that is formed integral, sewn to, affixed to, or otherwise connected to the glove portion 105.

The method further includes molding the rubber teething cap 150. The rubber teething cap 150 has opposing first surfaces and second surfaces. The first surfaces including teething elements 160.

The method including inserting the upper portion of the glove portion 105 including the flap 110 into the molded rubber teething cap 150. The method includes securing, such as using stitching, the fabric glove portion 105 to the rubber teething cap 150 such that the rubber teething cap 150 is reversible so as to selectively expose the opposing first and second surfaces of the molded rubber teething cap 150 as illustrated in FIGS. 4A, 4B, 5A, 5B, and 5C.

A first edge of the rubber teething cap 150 is attached to a side of the fabric glove portion 105 and a second edge of the rubber teething cap 150 is attached to a lower edge of the protective flap 110. The flap 110 can be connected to the second edge of the teething cap 150 such that when the teething cap 150 is inverted upon itself the flap 110 creates a protective layer over the second surface of the teething cap 150 as shown in FIGS. 4A and 5A, for example.

The glove portion 105 can include a protective surface. The protective surface such as a flap 110. The flap 110 can be contained within the teething cap 150 in the first teething position shown in FIG. 8A and exposed as an exterior protective surface 110 of the newborn anti-scratch and chew mitt 100 in the second protective position shown in FIG. 8B. The protective flap 110 can be in the form of a fabric flap 110 and connected to the glove portion 105 at a perimeter of the glove portion 150 contained within the teething cap 105 in the first position shown in FIG. 8A. In the second position shown in FIG. 8B, the fabric flap 110 is folded over the second surface of the teething cap 105 in the second position shown in FIG. 8B.

Thus, the fabric flap 110 forms an interior surface of the newborn anti-scratch and chew mitt 100 in the first teething position shown in FIG. 8A. And the fabric flap 110 forms an exterior surface of the newborn anti-scratch and chew mitt 150 in the second protective position shown in FIG. 8B.

The glove portion can be made fabric and open at a bottom end to receive the infant's hand up to the wrist. The teething surface of the teething cap 150 can include the teething elements extending therefrom. The teething elements can include protuberances, molded shapes, and ribs. The teething surface being invertible so as to contain the teething elements within an outer surface of the newborn anti-scratch and chew mitt 100 as shown in FIG. 8B. Thus, the teething cap 150 can have the teething surface disposed on a first surface of the teething cap and an interior of the teething cap is connected to the protective flap of fabric 110.

The glove portion 105 can contain a multiple layered construction, such as illustrated in FIG. 7, having an outer layer 121 and an inner layer 123 that are made of a fabric material, natural or synthetic, that has the general properties of a textile material. The use of outer and inner layers 121, 123 helps provide a moisture barrier. In addition, a crinkle layer 22 can be provided between the outer 121 and inner layer 123 according to some embodiments, or the crinkle layer 122 can be omitted according to other embodiments. The crinkle layer 122 can be made of a cellophane material commonly known as crinkle paper, which extends fully to the top 105A of the glove portion 105 shown in FIG. 6 to provide a crinkling noise when the glove portion 105 is flexed or fingers are wiggled and moved within the glove portion 105. The glove portion 105 is open at the bottom 105B and has an interior volume for accommodating the hand of the infant. The interior volume of the body 120 of the glove portion 105 extends substantially from the bottom 105B of the glove portion 105 to the top 105T of the glove portion 105.

Referring to FIG. 8, the teething cap 150 is shown according to an example embodiment. The teething cap 150 includes a top end 150T, a bottom end 150B, a front side 150F, a rear side 150R, a left side 150L and a right side 150R. The teething cap 150 has side walls that extends between the top end 150T and the bottom end 150B, and thereby defines an interior volume 155 therein. The cap 150 is preferably made of silicone and has an exterior surface that includes a plurality of protuberances 160. The protuberances 160 may be provided in a variety of shapes, patterns and/or indentations to ease the pain of the teething infant.

The teething cap 150 can include the stitching channel 170 and may include stitching apertures or grooves that facilitate connection to the glove portion 105. The bottom end 150B of the teething cap 150 can be generally straight in this embodiment, or can have irregular or curved shapes according to other embodiments, and allows the infant to place the teething cap 150 in his or her mouth as desired for teething. The teething cap 150 is constructed to be durable and withstand chewing and can thereby constructed of silicone material that is sufficiently thick and has an appropriate hardness to avoid puncturing, tearing or cutting therefrom. Silicone with a shore hardness rating of "30 to 40 shore A" is preferred for the teething cap 30, and silicone within the range of "20 to 60 shore A" is generally acceptable therefor.

As shown in FIG. 8, the teething cap can be composed of two portions according to some embodiments. The teething cap can include the front portion 150F and the rear portion 150R. The periphery of the portions 150F and 150R can be connected, such as sewn 172, along the sides and top periphery of the portions 150F and 150R. the bottom of the sides 150F and 150R are not connected, or sewn together, to accommodate the glove portion 105 therein. The connection 172 can also be used to connect the outer periphery of the sides and top of the portions 150F and 150R of the teething cap to a top and side periphery of the glove portion 105 and flap 110.

It is understood that when an element is referred hereinabove as being "on" another element, it can be directly on the other element or intervening elements may be present there between. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Herein is presented a newborn anti-scratch and chew mitt. The disclosure is illustrated by example in the drawing figures, and throughout the written description. It should be understood that numerous variations are possible, while adhering to the inventive concept. Such variations are contemplated as being a part of the present disclosure.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An anti-scratch and chew mitt, comprising:

a glove portion made of fabric closed at a top end to cover an infant's fingers and open at a bottom end to receive the infant's hand up to the wrist;

a teething cap extending over a top portion of the glove portion in a first teething position, the top portion of the glove portion extending within an interior volume of the teething cap when in the first teething position, the top portion of the glove portion is concealed to the bottom edge of the teething cap by the teething cap when in the first teething position;

the teething cap having teething elements disposed on a first surface of the teething cap, the teething elements being exposed about an outer surface of the teething cap in the first teething position;

the teething cap comprising two portions sewn together along a top peripheral edge and a side peripheral edge of the two portions of the teething cap; and the teething cap being reversible such that the teething cap is folded inside out in a second protective position, wherein the first surface of the teething cap is disposed within an interior of the teething cap in the second protective position.

2. The anti-scratch and chew mitt according to claim 1, the glove portion including a protective surface, the protective surface being contained within the teething cap in the first teething position and the protective surface being exposed as an exterior protective surface of the teething cap in the second protective position.

3. The anti-scratch and chew mitt according to claim 2, the protective surface being in the form of a fabric flap and connected to the glove portion at a perimeter of the glove portion contained within the teething cap in the first teething position.

4. The anti-scratch and chew mitt according to claim 3, wherein the fabric flap is folded over the second surface of the teething cap in the second protective position.

5. The anti-scratch and chew mitt according to claim 4, wherein:

the fabric flap forms an interior surface of the anti-scratch and chew mitt in the first teething position; and the fabric flap forms an exterior surface of the anti-scratch and chew mitt in the second protective position.

6. The anti-scratch and teething mitt according to claim 1, wherein a side of the glove portion is sewn to a lower peripheral edge of the teething cap.

7. A method of using the anti-scratch and teething mitt according to claim 1, comprising:

placing the infant's hand within the glove portion to protect the infant from scratching their self; and folding the cap inside-out and over an upper end of the glove portion to expose the teething elements allowing the infant to chew on the teething elements.

8. An anti-scratch and chew mitt, comprising:

a glove portion made of fabric closed at a top end to cover fingers of an infant and open at a bottom end to receive the infant's hand up to the wrist; and a teething surface including teething elements extending therefrom, the teething surface being invertible to contain the teething elements within an outer surface of the anti-scratch and chew mitt, wherein a side of the glove portion is stitched to approximately half of a lower periphery of a teething cap comprising the teething surface.

9. The anti-scratch and chew mitt according to claim 8, further comprising a teething cap including the teething surface disposed on a first surface of the teething cap.

10. The anti-scratch and chew mitt according to claim 9, wherein an interior of the teething cap is connected to a protective fabric.

11. The anti-scratch and chew mitt according to claim 10, wherein the teething cap is reversible thereby exposing the protective fabric as an exterior surface of the anti-scratch and chew mitt an containing the teething elements within an outer surface of the anti-scratch and chew mitt.

12. The anti-scratch and teething mitt according to claim 8, wherein a teething cap has the teething surface disposed within an interior of the teething cap in a protective configuration.

13. The anti-scratch and teething mitt according to claim 8, a side of the glove portion being coupled to a lower periphery of the teething surface.

14. The anti-scratch and teething mitt according to claim 8, further comprising a fabric layer being stitched to approximately half of the lower periphery of the teething cap.

15. The anti-scratch and teething mitt according to claim 8, the glove portion configured to cover the fingers of the infant to prevent the infant from scratching their self.

16. A method of using the anti-scratch and teething mitt according to claim 8, comprising:

placing the infant's hand within the glove portion to protect the infant from scratching their self; and folding the teething surface inside-out and over an upper end of the glove portion to expose the teething elements allowing the infant to chew on the teething elements.

17. A method of manufacturing the anti-scratch and teething mitt according to claim 8, comprising:

manufacturing the glove portion from a textile;

molding the teething surface from a polymer; and attaching the glove portion to the teething surface.

18. The method of manufacturing the anti-scratch and teething mitt according to claim 17, wherein:

the polymer includes silicone; and attaching the glove portion to the teething surface includes sewing the glove portion to the teething surface.

* * * * *